United States Patent [19]

Barrett

[11] Patent Number: 4,932,148

[45] Date of Patent: Jun. 12, 1990

[54] SHOULDER-FIRED SEMI-AUTOMATIC RIFLE

[76] Inventor: Ronnie G. Barrett, P.O. Box 1077, Murfreesboro, Tenn. 37130

[21] Appl. No.: 299,665

[22] Filed: Jan. 23, 1989

[51] Int. Cl.[5] ..... F41C 7/02; F41C 19/00

[52] U.S. Cl. ..... 42/18; 42/69.02; 42/71.01; 42/101; 89/1.42; 89/14.3; D22/103

[58] Field of Search ..... 42/6, 18, 22, 69.02, 42/71.01, 72; 89/1.42, 14.3, 33.1, 136, 139, 165, 166; D22/100, 103

[56] References Cited

U.S. PATENT DOCUMENTS

| | | | |
|---|---|---|---|
| 201,524 | 3/1878 | Henry et al. | 42/71.01 |
| 3,492,912 | 2/1970 | Ashbrook | 89/14.3 |
| 3,623,257 | 11/1971 | Ray | 42/71.01 |
| 4,651,455 | 3/1987 | Geiser | 42/18 |

FOREIGN PATENT DOCUMENTS

| | | | |
|---|---|---|---|
| 4361 | 11/1898 | United Kingdom | 42/71.01 |
| 645751 | 11/1950 | United Kingdom | 42/18 |

*Primary Examiner*—Stephen C. Bentley
*Attorney, Agent, or Firm*—Harrington A. Lackey

[57] ABSTRACT

A shoulder-fired semi-automatic rifle including an elongated housing, a barrel projecting forward from the housing, a bolt mechanism within the housing including a firing pin having a sear mechanism and a magazine depending from the housing and cooperating with the bolt mechanism. A shoulder seat depends from the housing immediately behind the magazine and is spaced substantially forward of the rear end of the housing. The trigger and trigger hand grip are mounted forward of the magazine. The trigger, spaced substantially in front of the sear mechanism, is connected to the sear mechanism through an elongated link member. A front hand grip also depends from the front portion of the housing in front of the trigger. The housing may also be provided with an upward projecting carrying handle located above the center of gravity of the rifle, when extending longitudinally horizontal.

8 Claims, 2 Drawing Sheets

SHOULDER-FIRED SEMI-AUTOMATIC RIFLE

BACKGROUND OF THE INVENTION

This invention relates to a semi-automatic rifle, and more particularly to a semi-automatic rifle especially designed for shoulder firing positions.

Semi-automatic rifles, such as the Browning automatic rifle (BAR), the semi-automatic rifle disclosed in Applicant's prior patent 4,677,897, and Pat. No. 4,867,040 issued Sept. 19, 1989, are designed to be used in a prone position. In these automatic rifles, the stock carrying a rear shoulder pad is fixed to the rear end of the housing and the front of the housing is usually supported upon a bipod so that the rifle is normally used in a prone position. In these rifles, both the shoulder pad and the hand grip and trigger are mounted on the housing behind the magazine, while the bipod is mounted on the front of the housing.

Although the above-semi-automatic rifles are quite effective when fired from the prone position, nevertheless, their construction and unbalanced weight do not render the rifle susceptible for use in any other firing position, and particularly in the standing, kneeling or sitting positions.

SUMMARY OF THE INVENTION

It is therefore an object of this invention to provide in a semi-automatic rifle of the above-described types a structure which will facilitate the use of the weapon in other firing positions than a prone position, and specifically in a standing, kneeling or sitting position, or any other position in which the rifle is supported solely by the shoulder and hands of the operator.

A further object of this invention is to provide a shoulder-fired semi-automatic rifle which is capable of being fired from a standing, kneeling or sitting position with little structural change in the internal mechanisms or a conventional semi-automatic rifle normally fired in a prone position.

A further object of this invention is to provide a bolt-operated semi-automatic rifle having a housing and a depending magazine, in which the shoulder pad or seat is located immediately behind the magazine and substantially forward of the rear end of the housing, while the trigger and trigger handle grip are spaced forward of the magazine and provided with linkage operatively connecting the trigger to the sear mechanism for firing the rifle in a standing, kneeling or sitting position.

Another object of this invention is to provide a shoulder-fired semi-automatic rifle in which the trigger is located substantially in front of the sear mechanism and in which an elongated link mechanism operatively connects the forward trigger to the existing trigger lever in the rear portion of the housing for firing the rifle.

A further object of this invention is to provide a shoulder-operated semi-automatic rifle in which the mass of the elements of the rifle including the housing, barrel, magazine, shoulder seat member and trigger are optimally balanced about the center of gravity of the rifle when it extends longitudinally horizontal to facilitate a single operator supporting the rifle upon his shoulder for firing in a standing, sitting or kneeling position.

DESCRIPTION OF THE PREFERRED EMBODIMENTS

Figure 1:
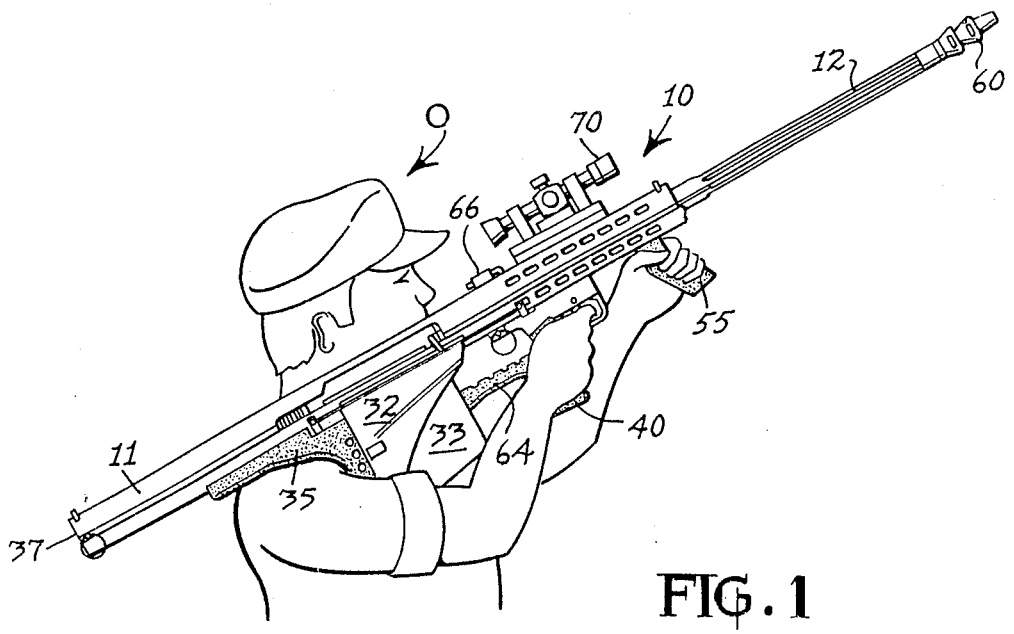
FIG. 1 is a side elevation of a semi-automatic rifle made in accordance with this invention in an operative position supported upon the shoulder of an operator for firing in a standing, sitting or kneeling position.
Figure 2:
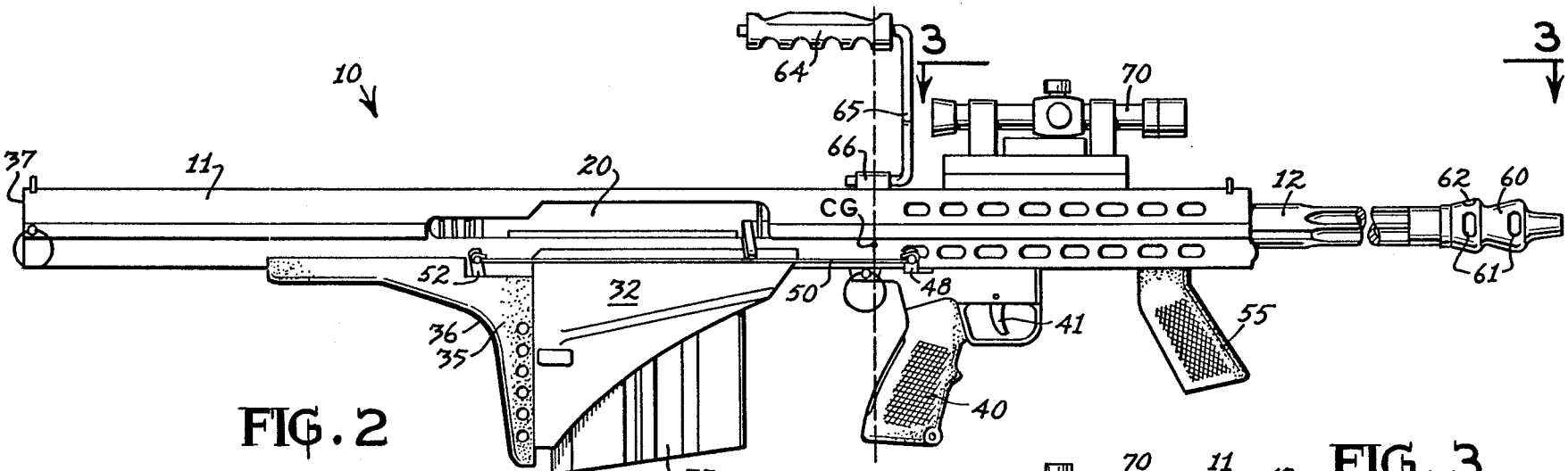
FIG. 2 is an enlarged side elevation of the rifle disclosed in FIG. 1, with portions of the barrel broken away.

Referring now to the drawings in more detail, FIGS. 1 and 2 disclose a shoulder-fired sem-automatic rifle 10 made in accordance with this invention including an elongated housing 11 and a recoiling barrel 12 projecting from the front end portion of the housing 11.

Figure 4:
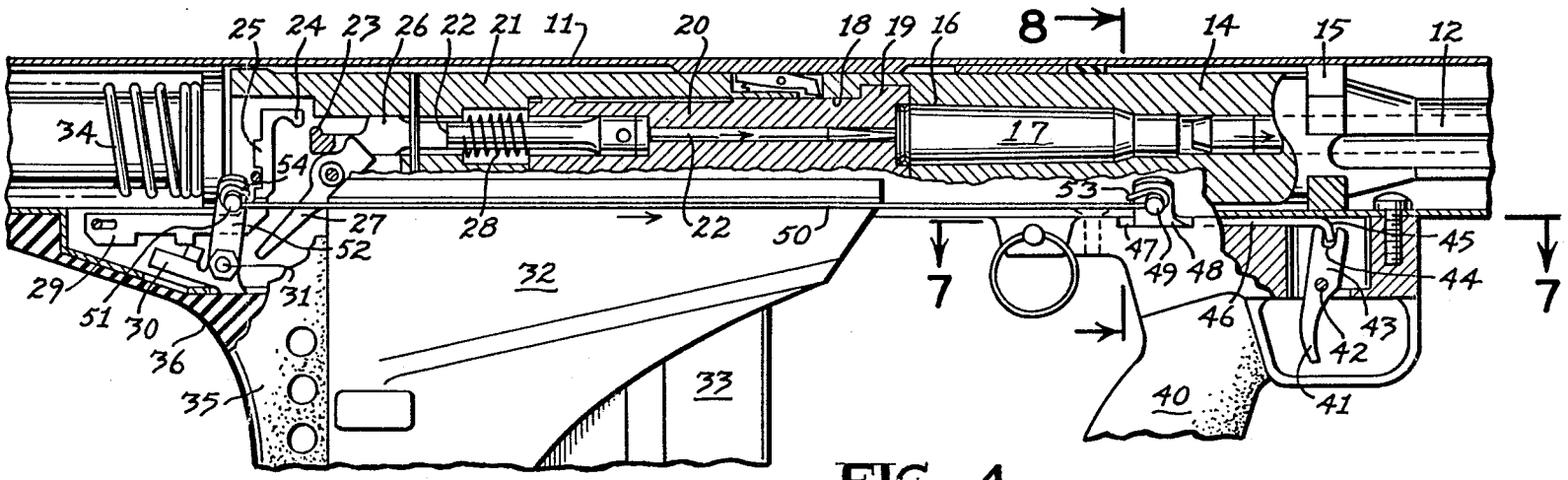
FIG. 4 is an enlarged fragmentary elevation of the intermediate portion of the rifle housing, with the operating portions shown in section, and illustrating the trigger mechanism in a firing position.

The barrel 12 disclosed in FIG. 4 includes a rear barrel extension 14 slidably mounted in the bushing 15 fixed on the inner wall of the housing 11. The barrel extension 14 includes a barrel chamber 16 for receiving a cartridge 17. The rear or battery end portion of the barrel extension 14 includes a plurality of circumferentially spaced barrel locking lugs 18 cooperating with bolt locking lugs 19 forming the front end portion of a bolt 20. The bolt 20 is reciprocably mounted in the bolt carrier 21 and includes an elongated firing pin 22 extending through both the bolt carrier 21 and the bolt 20 in a conventional manner. The rear end portion of the firing pin 22 includes a firing pin hook 23 adapted to cooperate with the sear hook 24 of a vertically reciprocable sear 25.

A vertical slot 26 in the rear portion of the firing pin 22 is adapted to receive a pivotal cocking lever 27. A coil spring 28 surrounding the firing pin 22 within the bolt carrier 21 normally urges the firing pin 22 forward.

The sear 25 is adapted to be raised to disengage the hooks 24 and 23 when the transfer bar 29 is raised by the trigger lever 30 pivoting in a clockwise direction about its pivot pin 31.

Figure 5:
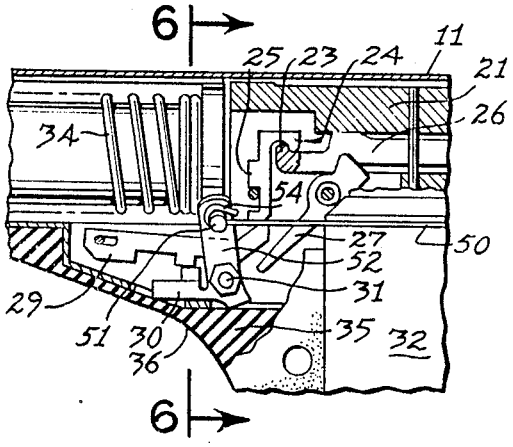
FIG. 5 is an enlarged fragmentary sectional elevation of the the rear portion of the rifle disclosed in FIG. 2, including the sear mechanism in an inoperative cocked position.
Figure 6:
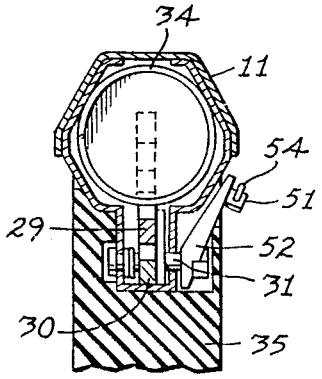
FIG. 6 is a fragmentary section taken along the line 6—6 of FIG. 5.
Figure 7:
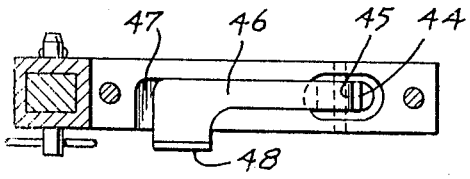
FIG. 7 is a horizontal sectional view taken along the line 7—7 of FIG. 4.
Figure 8:
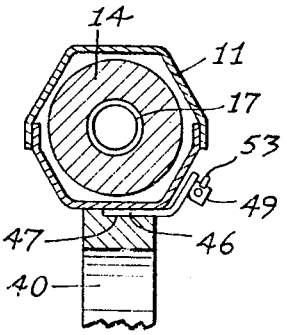
FIG. 8 is a fragmentary section taken along the line 8—8 of FIG. 4.

The parts thus far described are old in the art, as described in Applicant's co-pending application Ser. No. 115,821, filed Nov. 2, 1987. Moreover, the parts just described are best disclosed in FIGS. 4 and 5 of the drawings.

A conventional magazine holder 32 supporting a conventional magazine 33 is fixed to the bottom of the housing 11 in the same position at it is in the rifle disclosed in Applicant's prior patent application Ser. No. 115,821, in order to feed cartridges, one at a time, to the bolt 20 each time the bolt 20 reciprocates across and along the top of the magazine 33, and in a conventional manner.

The bolt carrier 21 is normally urged forward by the conventional recoil spring 34.

In the semi-automatic rifle 10 made in accordance with this invention, a shoulder seat member 35 including an arcuate padded shoulder surface or seat 36 is fixed to and depends from the bottom of the housing 11 so that it is adjacent and immediately behind the magazine holder 32, as best disclosed in FIGS. 1, 2, 4, and 5. This shoulder seat member 35 is mounted substantially forward of the rear end 37 of the housing 11 and is designed to fit the shoulder of the operator 0 (FIG. 1) in such a manner that the weight of the rifle 10 is more balanced for support upon the shoulder of the operator 0 closer to the center of gravity CG (FIG. 1).

Spaced in front of the magazine holder 32 and in front of the sear 25 is a trigger hand grip 40 depending from the housing 11 in the vicinity of the center of gravity CG and toward the forward end portion of the housing 11. Fixed immediately in front of the hand grip 40 is a trigger 41 pivotally mounted about the trigger pivot pin 42. The upper end portion 43 of the trigger member above the pivot pin 42 terminates in a bifurcated portion having a transverse groove 44.

Received in the transverse trigger groove 44 is the hooked front end 45 of an elongated slide member or slide plate 46 slidably received within a corresponding recess 47 within the bottom of the housing 11 immediately above the hand grip 40. Projecting laterally outboard from the slide plate 46 is a transverse connector ear 48 provided with a connector pin 49 operatively connected to the looped front end 53 of an elongated link rod 50. The rear end of the link rod 50 preferably terminates in a rear loop or looped end portion 54 operatively connected to a pin 51 on the free end of a trigger arm 52, the opposite end of which is fixed to the trigger lever 30 for simultaneous rotation about the pivot pin 31. The front looped end or loop 53 may cooperate with the front connector pin 49 by extending through a corresponding aperture (not shown) in the pin 49. The rear end loop 54 may cooperate with the rear connector pin 51 in the same manner as the front looped end 53 cooperates with the front connector pin 49.

Mounted and spaced in front of the trigger 41 is a front hand grip 55 affixed to and depending from the front end portion of the housing 11. The front hand grip 55 is designed to be gripped by the operator's hand which is not actuating the trigger 41. As disclosed in FIG. 1, the right-handed operator O grips the trigger hand grip 40 with his right hand and the front hand grip 55 with his left hand, while the shoulder seat member 35 rests upon the right shoulder of the operator 0. As disclosed in FIG. 1, the rifle 10 is substantially balanced upon the operator's right shoulder and both hands to facilitate firing in the standing, kneeling, or sitting position.

Figure 3:
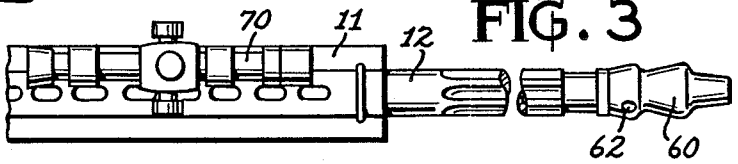
FIG. 3 is a fragmentary plan view taken along the line 3—3 of FIG. 2 of the front portion of the rifle, with a portion of the barrel broken away.

The front end portion of the barrel 12 may be provided with a muzzle brake 60 having the usual side gas ports 61. However, as disclosed in FIG. 3, in order to neutralize the kick, reaction or the recoil of the rifle 10 upward and to the right, when fired, an additional gas port 62 is formed in the muzzle brake 60 above the barrel 12, when in a horizontal position, and to the right, when the observer is looking forward. In other words, the gas port 62 is mounted in an orientation at one o'clock when looking in the forward direction. Gas discharged through this port tends to neutralize the movement or recoil and reaction movement of the barrel 12 upward and the the right.

The rifle 10 is preferably provided with a carrying handle 64 which is pivotally connected by a handle arm 65 to a swivel joint 66 fixed to the top of the housing 11. The swivel joint 66 and the carrying handle 64 are preferably located above the center of gravity CG when the housing 11 extends horizontally, to facilitate carrying the rifle 10 in a balanced position.

The rifle 10 is also preferably provided with an elongated glass sight or telescopic sight 70 which is mounted in front of the handle member 64 and fixed to the top of the housing 11.

It is thus apparent, particularly from FIGS. 1 and 2, that all of the elements of the rifle 10, both the conventional elements and the additional elements, are so spaced and located not only to facilitate the firing of the weapon 10, but also to provide a substantially balanced load including the mass of all the elements about the center of gravity CG. In this manner, the balanced weights of the parts facilitate the support of the rifle 10 upon the shoulder of the operator 0 for comfort and improved accuracy of the weapon, particularly in a standing, sitting or kneeling position.

What is claimed is:

1. A shoulder-fired semi-automatic rifle comprising:

(a) an elongated housing having a rear end portion, a front end portion, and an intermediate portion, (b) an elongated barrel mounted within and projecting forward from said front end portion of said housing, and having a rear battery end portion, (c) bolt means comprising an elongated reciprocable firing pin having a rear hook, within said intermediate portion of said housing and cooperative with said battery end portion for firing a cartridge within said battery end portion when said bolt means is actuated, (d) a vertically movable sear within said intermediate portion of said housing for operatively engaging and disengaging said rear hook, (e) a pivotally mounted trigger lever mounted in said housing below said sear, (f) a pivotally mounted transfer bar operatively engaging said trigger lever and said sear, (g) a shoulder seat member mounted on and depending from the intermediate portion of said housing, said seat member being spaced substantially in front of said rear end of said housing and immediately below said sear, said shoulder seat member being adapted to rest upon the shoulder of an operator of said rifle, (h) a trigger hand grip depending from said intermediate portion of said housing and spaced in front of said shoulder seat member, (i) a trigger pivotally mounted on said housing immediately in front of said trigger hand grip, said trigger being spaced substantially in front of said sear, (j) an elongated link member extending along said housing and operatively connecting said trigger and said trigger lever whereby actuation of said trigger pivots said trigger lever to disengage said sear from said rear hook to cause said firing pin to fire the cartridge in said battery end portion of said barrel, and (k) a front hand grip fixed to and depending from said front end portion of said housing and spaced in front of said trigger.

2. The invention according to claim 1 in which said trigger has an upper end and said elongated link member comprises an elongated forward slide member having a front end portion operatively connected to said upper end of said trigger, an elongated link rod having front and rear ends, said front end of said link rod being operatively connected to said slide member and said rear end of said link rod being operatively connected to said trigger lever.

3. The invention according to claim 2 further comprising a link arm fixed to said trigger lever for pivotal movement therewith, said rear end of said link rod being operatively connected to said link arm.

4. The invention according to claim 3 in which said slide member further comprises an ear projecting laterally from said slide member and a connector member operatively connecting the front end of said link rod to said ear.

5. The invention according to claim 1 further comprising a magazine fixed to and depending from the intermediate portion of said housing and cooperative with said bolt for feeding cartridges to said bolt means, said magazine being located immediately in front of said shoulder seat member and spaced behind said trigger hand grip.

6. The invention according to claim 5 in which said housing includes a center of gravity, and further comprising a carrying handle member fixed to said housing for upward projection in the vicinity of said center of gravity.

7. The invention according to claim 6 further comprising an elongated sight member fixed to and projecting upward from said housing in front of said carrying handle member.

8. The invention according to claim 1 further comprising a muzzle brake on the front end portion of said barrel, and a gas port in said muzzle brake disposed above and to the right of said barrel looking forward.

* * * * *